United States Patent [19]

Moser et al.

[11] 4,431,086

[45] Feb. 14, 1984

[54] ELEVATOR SYSTEM

[75] Inventors: Thomas D. Moser, Murrysville, Pa.; Christopher J. Amenson, Boston, Mass.; Eliezer Sternheim, Pittsburgh, Pa.

[73] Assignee: Westinghouse Electric Corp., Pittsburgh, Pa.

[21] Appl. No.: 344,252

[22] Filed: Jan. 29, 1982

[51] Int. Cl.[3] ..... B66B 1/18

[52] U.S. Cl. ..... 187/29 R; 340/20; 179/2 A

[58] Field of Search ..... 187/29; 179/2 A, 2 DP, 179/18 B; 340/19, 20, 825.31

[56] References Cited

U.S. PATENT DOCUMENTS

| | | | |
|---|---|---|---|
| 3,911,223 | 10/1975 | Burger et al. | 179/2 DP |
| 3,973,648 | 8/1976 | Hummert et al. | 187/29 |
| 3,984,637 | 10/1976 | Caudill et al. | 179/2 DP |
| 4,051,326 | 9/1977 | Badagnani et al. | 179/2 A X |
| 4,095,050 | 6/1978 | Beachem et al. | 179/2 A |

*Primary Examiner*—J. V. Truhe
*Assistant Examiner*—W. E. Duncanson, Jr.
*Attorney, Agent, or Firm*—D. R. Lackey

[57] ABSTRACT

An elevator system having a plurality of elevator cars under group supervisory control. An auxiliary dispatching control is connected to the existing telephone system of the building, arranged to enable callers to have cars dispatched to predetermined floors at selectable times of the day.

9 Claims, 9 Drawing Figures

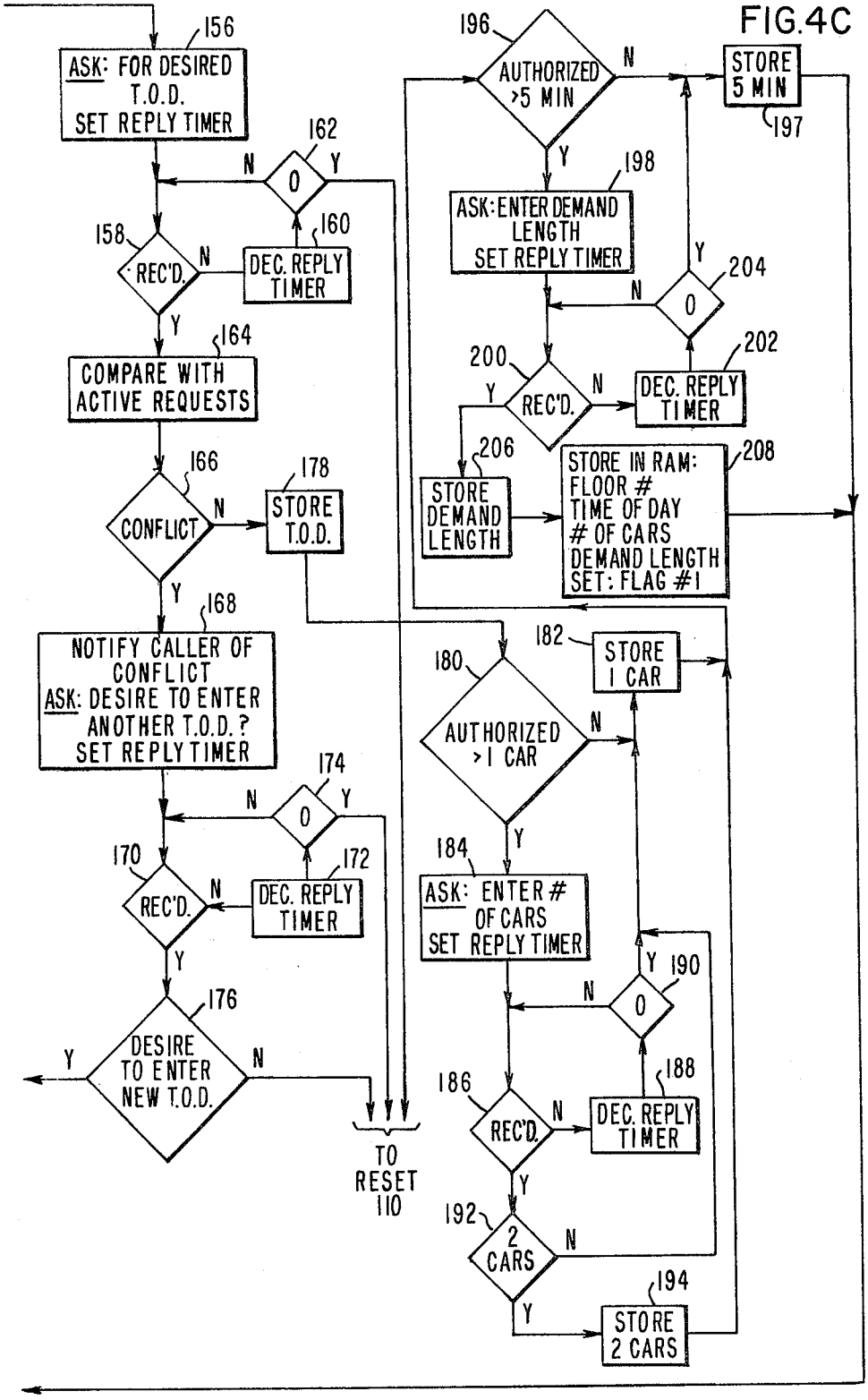
FIG.4C
156
ASK: FOR DESIRED T.O.D. SET REPLY TIMER
162
0
N
Y
158
REC'D.
N
160
DEC. REPLY TIMER
Y
164
COMPARE WITH ACTIVE REQUESTS
166
CONFLICT
N
178
STORE T.O.D.
Y
168
NOTIFY CALLER OF CONFLICT ASK: DESIRE TO ENTER ANOTHER T.O.D.? SET REPLY TIMER
174
0
N
Y
170
REC'D.
N
172
DEC. REPLY TIMER
Y
176
DESIRE TO ENTER NEW T.O.D.
Y
N
TO RESET 110
196
AUTHORIZED >5 MIN
N
STORE 5 MIN
197
Y
198
ASK: ENTER DEMAND LENGTH SET REPLY TIMER
Y
204
0
N
200
REC'D.
Y
N
202
DEC. REPLY TIMER
206
STORE DEMAND LENGTH
208
STORE IN RAM: FLOOR # TIME OF DAY # OF CARS DEMAND LENGTH SET: FLAG #1
180
AUTHORIZED >1 CAR
N
182
STORE 1 CAR
Y
184
ASK: ENTER # OF CARS SET REPLY TIMER
Y
190
0
N
186
REC'D.
N
188
DEC. REPLY TIMER
Y
192
2 CARS
N
Y
194
STORE 2 CARS

ELEVATOR SYSTEM

BACKGROUND OF THE INVENTION

1. Field of the Invention

The invention relates in general to elevator systems, and more specifically to elevator systems having a plurality of elevator cars under group supervisory control.

2. Description of the Prior Art

It is common in prior art elevator systems which include a plurality of elevator cars under the supervision of group supervisory control, to improve elevator service by including one or more parking features. For example, in a zone oriented system, a non-busy zone car may be parked at a predetermined floor of its zone with its doors closed and the hall lanterns off. In another type of system, a non-busy car may be parked at a floor located approximately at the midpoint of the building, with its doors closed and hall lanterns off. In buildings which regularly vacate a predetermined floor at a predetermined time of the day, a clock may be used to park or "spot" one or more cars at the floor just prior to the start of the service demand from that floor. Demand features may also utilize actual evidence of a demand peak from a floor to automatically dispatch another car to the floor. For example, if two elevator cars leave a floor with a full load within a predetermined period of time, the system may send available cars to the floor, with one parking at the floor with its doors closed and hall lanterns off while another car serves the floor. When the car serving the floor closes its doors in preparation to leave the floor, the parked car will open its doors and turn on its appropriate hall lantern. When a car leaves this floor with less than a predetermined load, it cancels the demand for this floor.

Certain of these methods are statistical in nature. The dispatching logic is never quite sure whether more than one car is needed to satisfy a demand; or, what time of the day a demand will actually occur; or, what duration the demand will have. Still other methods have an inherent time lag, as a demand has to actually occur before the system responds to accommodate it. Further, if a tenant, for security reasons, for example, would like to have a car at a particular floor at a given time of day, the prior art elevator systems do not have an easily implemented arrangement for satisfying this need.

SUMMARY OF THE INVENTION

Briefly, the present invention is a new and improved elevator system having a plurality of elevator cars under group supervisory control, including auxiliary dispatching control means connected to the existing telephone system in the building. The auxiliary dispatching control means includes automatic telephone answering equipment. This equipment may include an audio tape, for example which is periodically started to give the caller instructions and to ask questions, and stopped to await answers to specific questions. In a preferred embodiment, a solid state speech synthesizer unit performs the audio communication function. This unit composes audible speech from a digitized vocabulary source to provide verbal messages selected by a microprocessor from a message center. The responses by the caller are in the form of tones entered directly on the keyboard of a touch-tone telephone; or if the telephone is of the dial type, the responses may be made by the caller via a commercially available hand-held tone generator. The caller, via an interactive program, after being cleared via a security procedure which includes entry of a code by the caller, can (a) place a normal hall call for his floor via the telephone, to reduce waiting time, (b) cause an available empty car to be dispatched directly to the caller's floor, such as for security reasons, either immediately, or at a predetermined future time of the day, and, if enabled by his assigned code, (c) cause one or more elevator cars to be assigned to the caller's floor, starting at a predetermined time of the day, for a period of time selected by the caller, in order to expeditiously serve a future sustained demand which the caller knows will occur.

BRIEF DESCRIPTION OF THE DRAWINGS

The invention may be better understood, and further advantages and uses thereof more readily apparent, when considered in view of the following detail description of exemplary embodiments, taken with the accompanying drawings in which.

DESCRIPTION OF PREFERRED EMBODIMENTS

Figure 1:
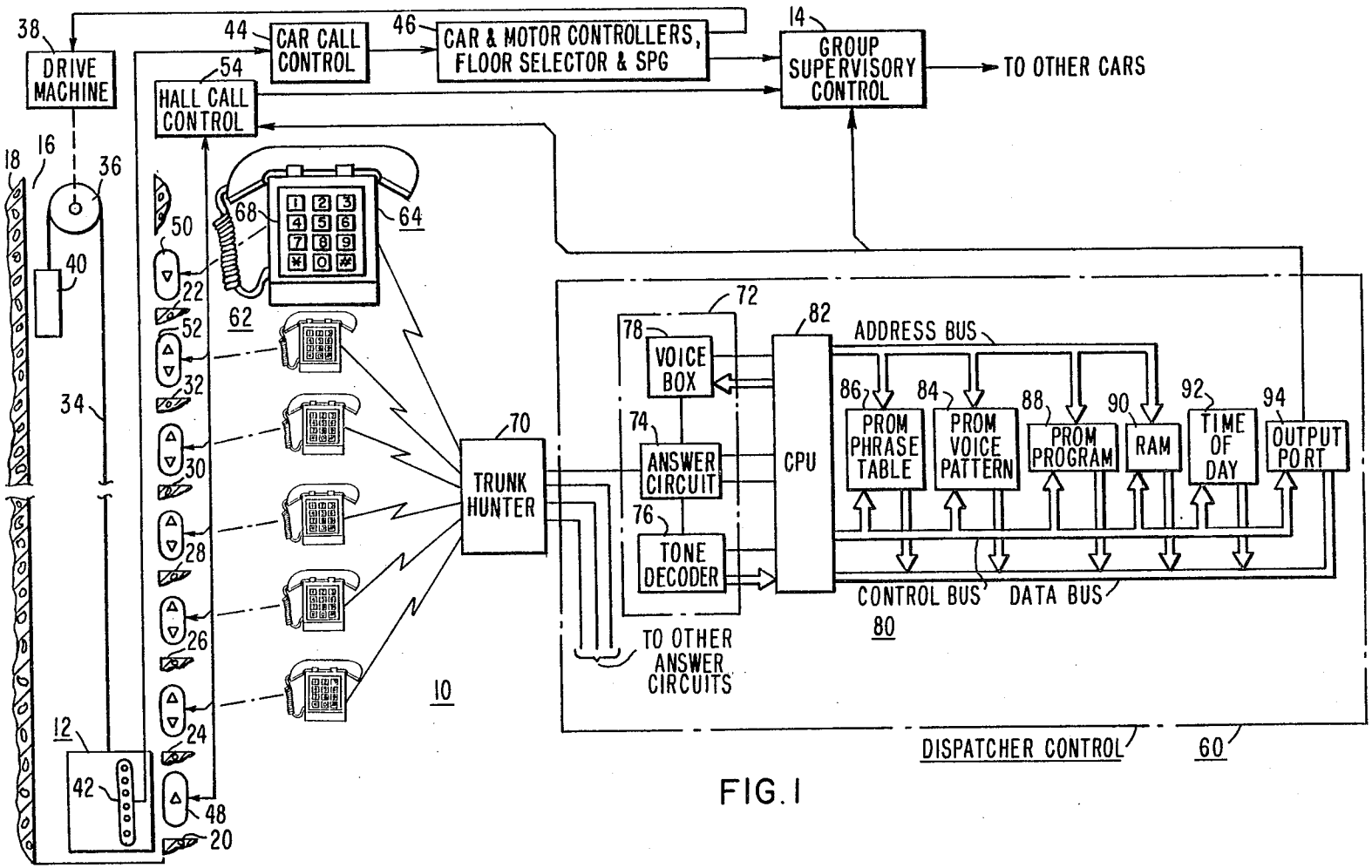
FIG. 1 is a partially diagrammatic and partially schematic view of an elevator system constructed according to the teachings of the invention.

Referring now to the drawings, and to FIG. 1 in particular, there is shown a partially diagrammatic and partially schematic view of an elevator system 10 constructed according to the teachings of the invention. For purposes of example, elevator system 10 will be assumed to be the elevator system which is collectively set forth in U.S. Pat. Nos. 3,750,850, 3,804,209, and 3,851,734, which are assigned to the same assignee as the present application. These patents are hereby incorporated into the present application by reference. U.S. Pat. No. 3,750,850 discloses elevator controls suitable for operating a single elevator car according to a predetermined strategy. U.S. Pat. No. 3,804,209 illustrates how the individual strategies of a plurality of elevator cars in the building may be overridden by group supervisory control. U.S. Pat. No. 3,851,734 illustrates group operating strategy which may be used to cause the plurality of elevator cars to efficiently serve calls for elevator service.

More specifically, elevator system 10 includes a plurality of elevator cars, such as car 12, the movement of which is controlled by group supervisory control 14, such as of the type which includes a system processor of the programmable type. Such system processors include a core memory having a software package, i.e., instructions stored therein, and a central processing unit for executing the stored instructions to direct the elevator cars to efficiently serve requests for elevator service. The system processor prepares and transmits signals to the elevator cars to direct them to serve the requests for elevator service according to the specific strategy defined by the instructions. Since each of the elevator cars of the bank of elevator cars, and the controls therefor, are similar in construction and operation, only the controls for car 12 are shown in FIG. 1.

Elevator car 12 is mounted in a hoistway 16 for movement relative to a structure 18 having a plurality of floors or landings. For example, FIG. 1 illustrates the lowest floor 20, the highest floor 22, and a plurality of intermediate floors, including floors indicated by references 24, 26, 28, 30 and 32.

Car 12 is supported by a plurality of wire ropes 34 which are reeved over a traction sheave 36 mounted on the shaft of a drive machine 38, which may include a direct current motor, such as used in the Ward-Leonard drive system, or in a solid state drive system. A counterweight 40 is connected to the other ends of the ropes 34.

Car calls, as registered by pushbutton array 42 mounted in the elevator car 12, are recorded and serialized in car call control 44, and the resulting serialized car call information is directed to the floor selector shown generally within the car controls 46.

Hall calls, as registered by pushbuttons mounted in the hallways, such as the up pushbutton 48 located at the lowest level 20, the down pushbutton 50 located at the uppermost landing 22, and the up and down pushbuttons 52 located at the intermediate landings, are recorded and serialized in hall call control 54. The resulting serialized hall call information is direcfed to the group supervisory control 14. The group supervisory control 14 directs the hall calls to selected elevator cars, to effect efficient service for the various floors of the building and effective use of the elevator cars.

The floor selector in car controls 46 develops information concerning the position of the car 12 in the hoistway 16, and it also provides signals for controlling a speed pattern generator in controls 46. The speed pattern generator generates a speed reference signal for a motor controller in controls 46, which in turn provides the signals for controlling the drive voltage for the drive machine 38. In other words, the floor selector keeps track of the car 12 and the calls for service for the car, it provides the request to accelerate signal to the speed pattern generator, and it provides the deceleration signal for the speed pattern generator at the precise time required for the elevator car to decelerate according to a predetermined deceleration pattern and stop at a predetermined floor for which a call for service has been registered. The floor selector also provides signals for controlling such auxiliary devices as the door operator and the hall lanterns, and it controls the resetting of the car call and hall call controls when a car call or hall call has been serviced. According to the teachings of the invention, auxiliary dispatching control 60 is provided which is connected to the existing telephone system 62 of the building 18. The telephones, such as the telephone 64 shown within magnified circle 66, preferably include a touch-tone keyboard 68. If the telephones are of the rotary dial type, the tones may be generated by the caller, after completing a call, via a hand-held tone generator, such as Teltone's No. M101. The caller provides information relative to his request for elevator service via the tones or frequencies generated by the touch-tone keyboard.

In order for the dispatcher control 60 to handle more than one incoming call at a time, a conventional telephone trunk hunter 70 may be provided. Trunk hunters may be obtained from Bell Telephone or GTE. The trunk hunter 70 has several lines and telephone numbers assigned to it, and if a number called is busy, it will automatically seek out a non-busy line for connection to the dispatcher control 60.

Each line includes answering means, such as the answering means 72 shown within the broken outline. Thus, if there are four lines, for example, four answering means 72 would be provided. Each answering means includes an answer circuit, which simply may be a circuit which changes voltage level when the trunk hunter 70 connects a call thereto. Each answering means further includes a tone decoder 76 for decoding the tones to binary, or BCD form. Finally, the answering means includes a voice box 76. The voice box may be one or more audio tapes which are started to provide audio instructions to the caller, and stopped to receive the responses requested of the caller.

In a preferred embodiment, the voice box 76 includes a speech synthesizer, such as Texas Instruments' TMS 5200. A microprocessor 80 having a CPU 82 is programmed to provide digitized voice information having a vocabulary source stored in PROM 84, to construct different messages. The instructions for formulating each message are stored in PROM 86, with the instructions being referred to as the phrase table. Thus, for a specific message, PROM 86 instructs which patterns to retrieve from PROM 84 and store in the memory of the speech synthesizer chip in the voice box 78. The voice box would also include a filter and amplifier for the message which becomes audible in the earphone receiver of the caller. For further detailed information on an operative speech synthesizer system, see co-pending application Ser. No. 215,893, filed Dec. 12, 1980, entitled "Elevator System," which application is assigned to the same assignee as the present application.

The voice synthesizer is an attractive embodiment because of the low maintenance required, and also because the microprocessor which services it can also be used to run the interactive telephone program, and a program for creating timely demands on the elevator system to satisfy telephone placed dispatching requests. Thus, microprocessor 80 may also include a PROM 88 for storing the telephone and demand programs, a RAM 90 for storing the telephone placed dispatching requests, a time-of-day clock 92, and an output port 94. Output port 94 is used for placing hall calls on the hall call control 54, for sending signals to the group supervisory control which creates demands for available cars, and is sending information to the group supervisory control relative to the demands.

Figure 2:
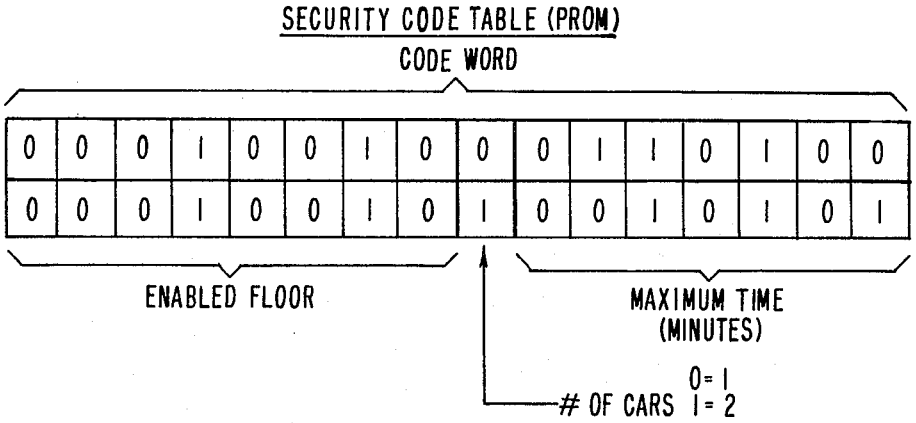
FIG. 2 is a ROM map setting forth an example of a Security Code Table which may be stored in the PROM shown in FIG. 1.

In order to prevent unauthorized personnel from making hall calls and creating system demands via the telephone, the telephone number, or numbers, of the auxiliary dispatcher call 60 would only be given to authorized personnel. This would be a first step in a multi-level security system. Upon using an authorized telephone number and gaining access to the auxiliary dispatcher control 60, the automatic answering arrangement will immediately answer the call by identifying the phone as an elevator dedicated phone, and it will ask that the caller's security code be entered via the touch-tone phone keyboard, or auxiliary tone generator. Each person authorized to place calls and/or demands for elevator service via the telephone, in addition to being given a telephone number, would be given a security code. A security code table is then prepared and stored in PROM 88, with a suitable format for a code listing being shown in FIG. 2. This table includes each security code listing authorized for use. For example, two 8-bit words may be used for code storage. The code word shown in FIG. 2 is a 4-digit code 1-2-3-4 in BCD, but straight binary may be used, if desired.

As an adjunct to each code listing, the format also lists the building floor the possessor of the code is authorized to place hall calls for, or to create demands for. Thus, another 8-bit word may be used to store the enabled floor number. The enabled floor set forth in FIG. 2, for purposes of example, is floor No. 12, which is shown in BCD.

If the caller represents a tenant having a plurality of employees requiring more than one elevator car to satisfy the demand when the employees leave the building, the caller may be authorized to request two cars, for example. Bit position 7 of another 8-bit word may be used to indicate the numbr of cars the caller is authorized to request. A "0" at this bit position indicates one car, and a "1" indicates two cars.

If the caller is authorized to create a demand for a predetermined period of time, during which demand interval the elevator system will attempt to maintain a predetermined quota of cars at the associated floor to satisfy the demand, the maximum authorized demand time in minutes may be listed in the first 7 bits of the last 8-bit word shown in the format. The time illustrated is 15 minutes in BCD, with bit position 7 always being assumed to be a zero when examining the authorized demand interval.

Figure 3:
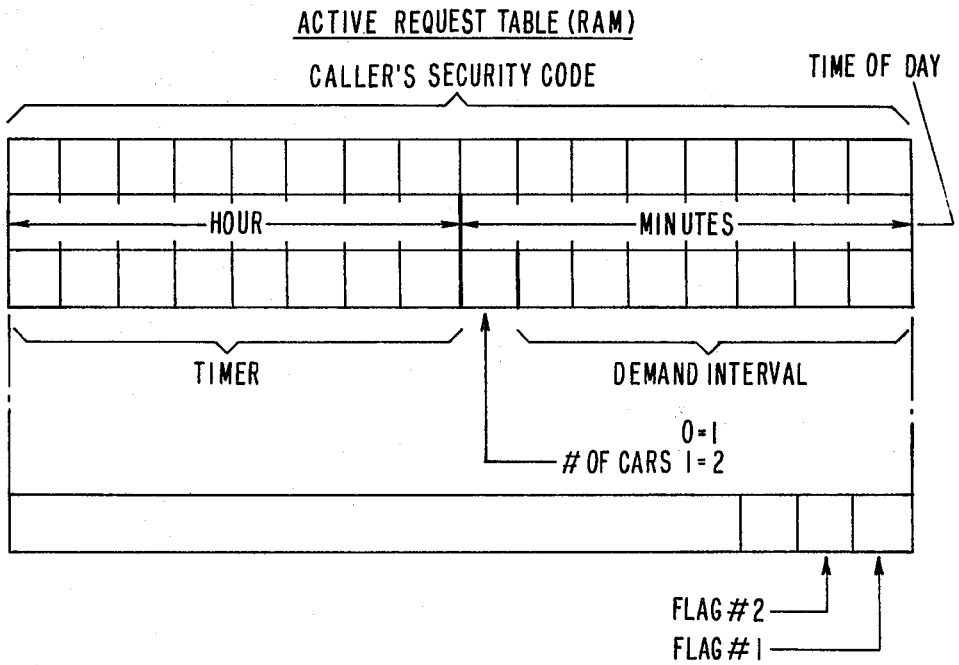
FIG. 3 is a RAM map of an Active Request Table which may be stored in the RAM shown in FIG. 1.

When an authorized demand is entered, it is stored in RAM 90, with a suitable format for its storage being shown in FIG. 3. Each active request may be stored in a location requiring the space of six 8-bit words. Two 8-bit words may be used to store the caller's security code number. Since the code automatically identifies the associated floor number, the floor number need not be stored. The next two 8-bit words may store the hour and minutes of the time of day at which the demand interval is to start. A single 8-bit word may store the number of cars in the demand quota, at bit position 7, and bit positions 0–6 may indicate the length of the demand interval. The remaining 8-bit word may be a software timer which is "started" at the start of the demand interval in order to determine when the demand interval has expired. Alternatively, the microprocessor may simply add the demand interval to the time of day at which the demand interval starts, and store this time in the positions of the last two 8-bit words. Thus, the microprocessor may start and stop the demand interval by comparison of stored time values with the time-of-day clock 92.

The last 8-bit word of the active request table may include bit positions for various software flags, such as flag No. 1 and flag No. 2 illustrated at bit positions 0 and 1, the use of which will be hereinafter explained. A software "reply" timer, if used, may also be set up next to the flag positions.

Figures 4, 4A:
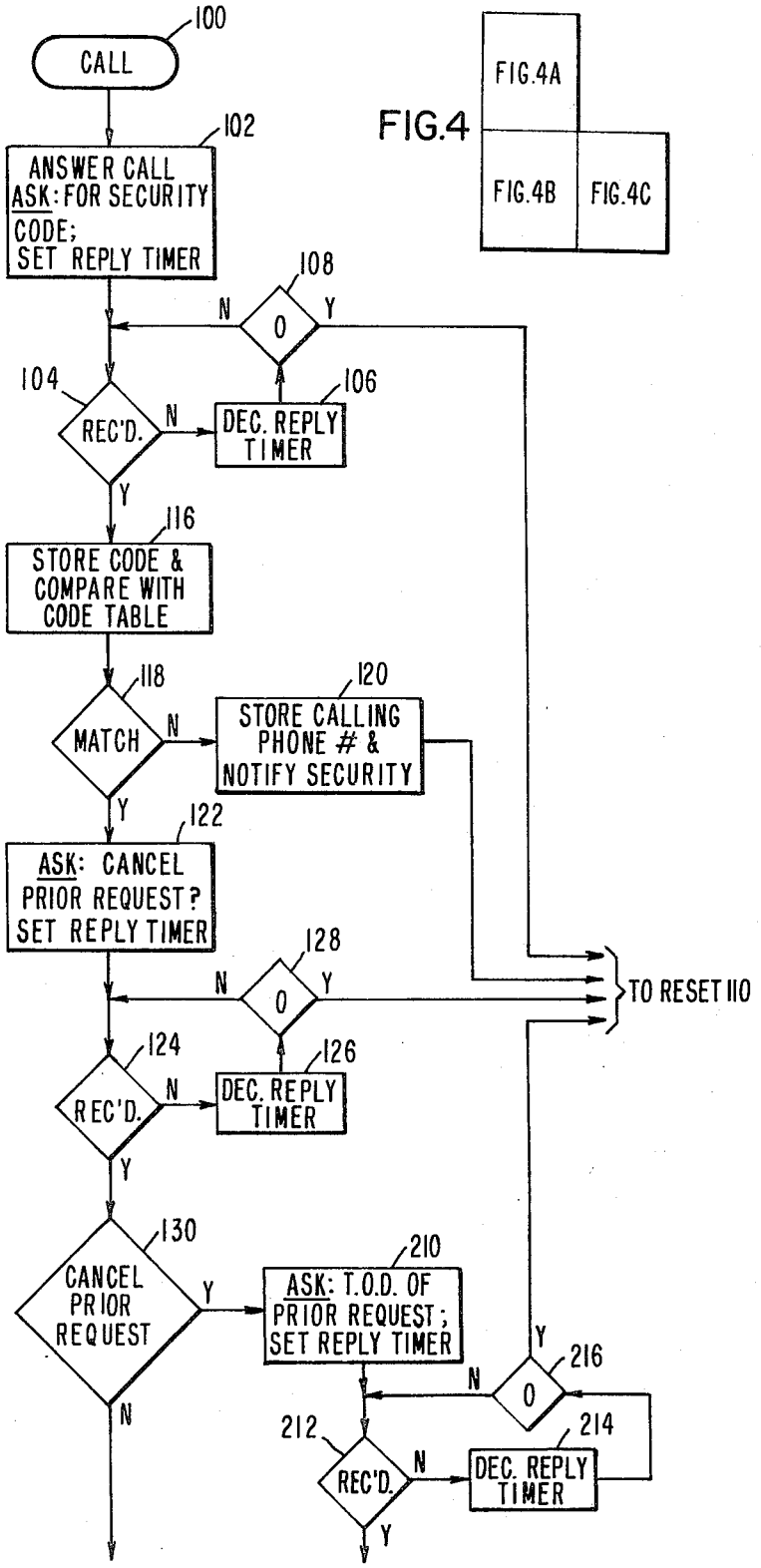
FIG. 4 illustrates how FIGS. 4A, 4B and 4C may be assembled as shown in FIG. 4 to set forth a flow diagram of an interactive telephone program which may be used by a caller to enter requests for elevator service, via the telephone, into the elevator system of the building.
Figure 4B:
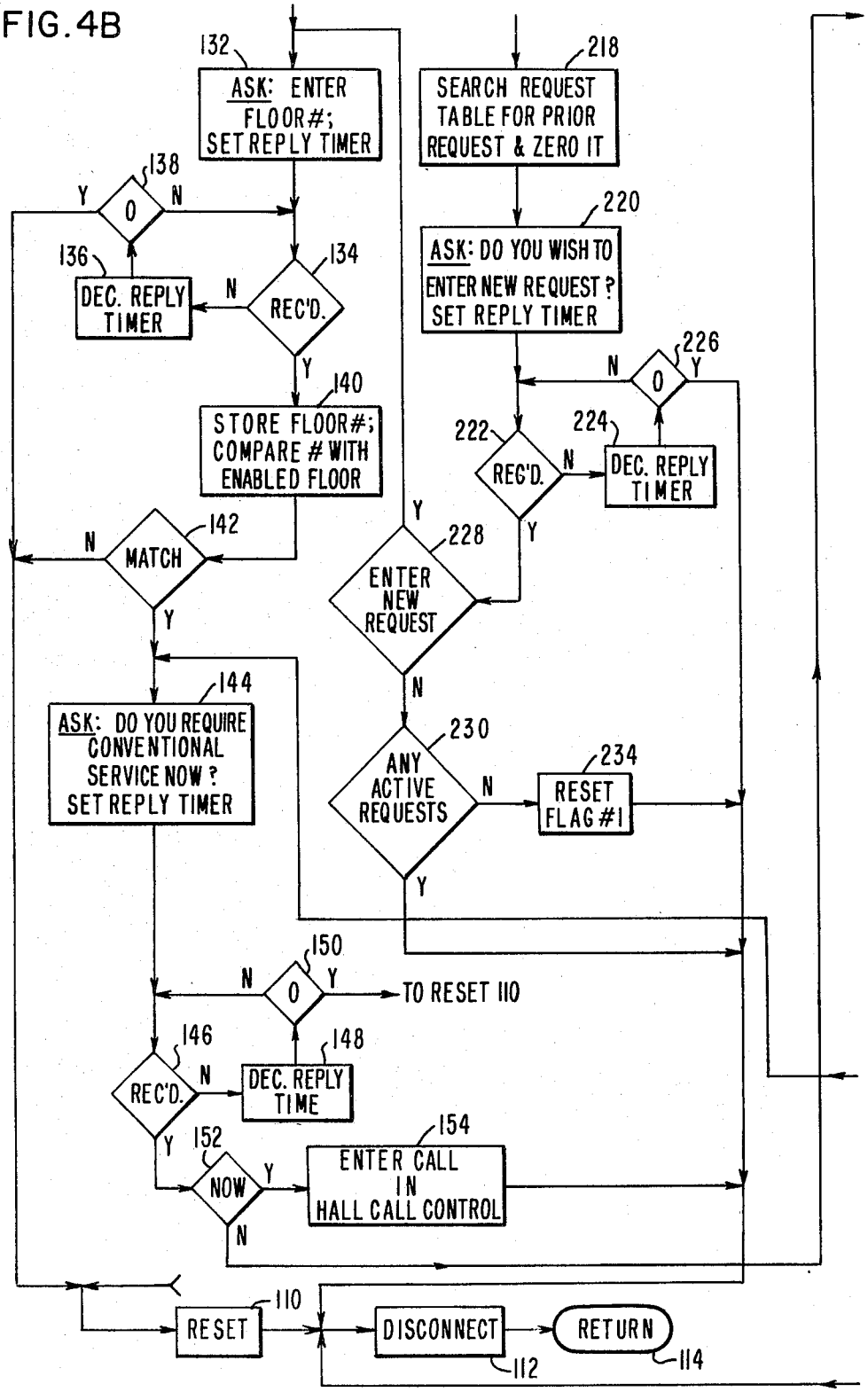

FIGS. 4A,4B and 4C may be assembed to provide a detailed flow diagram of an interactive telephone program which may be stored in PROM 88 for directing the input of hall calls and special floor demands into the elevator system 10 via the existing telephone system 62 in the building 18. The program is entered at 100 when the caller places a call which is answered by the trunk hunter 70 by connecting the caller with an answer means 72. Step 102, in addition to answering the call by notifying the caller that he has been connected to the elevator dispatching system, asks for the caller to enter his security code. The program then sets a reply timer which gives the caller a predetermined amount of time in which to enter the code. The program then loops through steps 104, 106 and 108 until either receiving the code, or the reply timer times out before the code is received. If the timer times out before a reply is received, step 108 advances to step 110, which resets the information entered to this point, step 112 disconnects the telephone connection, and the program returns at step 114.

Instead of setting up and maintaining a reply timer, the time-of-day clock 92 may be used to set up the reply time. For example, step 102 may add 10 seconds to the present time of day and store the result. The loop would then keep checking the present time of day with the stored value until the time expires.

If the caller enters the code before the reply time expires, step 116 stores the code and compares it with the authorized code entries in the security code table shown in FIG. 2. Step 18 determines if the entered code matches an authorized code in the listing, and if it does not match, step 120 may store the calling phone number and notify the building security. Step 120 then advances to the reset step 110.

If step 118 finds the caller's code matches a listing in the security code table, step 122 asks the caller if he wishes to cancel a prior request for elevator service. Step 122 also sets the reply timer. Steps 124, 126 and 128 then provide the delay necessary in order for the caller to enter his answer. Instructions given the callers at the time they are authorized to join the authorized group, specify which buttons on the keyboard to depress for "yes" and "no" answers. When the reply is received, step 130 examines it, and it will first be assumed that the answer was "no," i.e., that the caller does not wish to cancel a prior request. The "yes" branch will be described hereinafter.

Thus, the "no" branch from step 130 indicates that the caller wishes to enter a new request for elevator service and as an additional security check step 132 asks the caller to enter his floor number. Step 132 then sets the reply timer and steps 134, 136 and 138 provide the reply delay. When the reply is received, step 140 stores the floor number and compares it with the floor which has been enabled by the caller's code. Step 142 determines if the entered floor number matches the enabled floor, and if it does not, the program may advance to step 110, or it may return to step 120, as desired. If the entered floor number matches the enabled floor, the program advances to step 144 and the caller is asked if he requires conventional elevator service at the present time. In other words, the caller is asked if he wishes to place a conventional hall call for elevator service for his floor. Step 144 sets the reply timer and steps 146, 148 and 150 provide the reply delay. When the reply is received, step 152 examines the answer, and if the caller desires conventional elevator service, step 154 provides an output which will be sent to the hall call control 54 in FIG. 1 for setting a hall call for the caller's floor. Step 154 then advances to step 112 to disconnect the call and return to other matters.

If step 152 finds that the caller does not wish to enter a conventional hall call, step 156 asks the caller to enter the desired time of day at which he desires elevator service, with the entry format for the time of day being given to the caller in his printed instructions at the time he is authorized to place such calls. Step 156 also set the reply timer and steps 158, 160 and 162 provide the reply timer. When the reply is received, step 164 compares the entered time of day with other active requests for elevator service which are already stored in the active request table shown in FIG. 3. Step 166 answers the question as to whether or not there is a conflict, and if there is, step 166 advances to step 168 which notifies the caller of the conflict and asks if he desired to enter another time of day. Step 168 then sets the reply timer and steps 170, 172 and 174 provide the reply timer. Step 176 examines the caller's answer, and if he does not wish to enter a new time-of-day request, the program advances to step 110 to reset the call information and disconnect the call. If he desires to enter a new time-of-day request the program returns to step 144.

If step 166 found no conflict between the entered time of day and the service requests already logged in the active request table shown in FIG. 3, the program advances from step 166 to step 178, which stores the new time-of-day request in the active request table. Step 180 then checks the appropriate bit position of the security code table to see if the caller is authorized to request more than one car. If he is not, the program advances to step 182 which stores one car in the active request table shown in FIG. 3. If the caller is authorized for more than one car, step 180 advances to step 184 which asks the caller to enter the number of cars he desires to have available to answer his demand. Step 184 also sets the reply timer and steps 186, 188 and 190 provide the reply delay. Step 192 examines the reply, and if the reply requests two cars, step 194 stores two cars in the active request table, and if he does not request two cars, step 192 advances to step 182 to store one car in the request table. Steps 182 and 194 both advance to step 196 to see if the caller is authorized for more than a predetermined minimum period of time. The maximum time which the caller is authorized to select is stored in the security table shown in FIG. 2. If the caller is not authorized for more than five minutes, for example, the program advances to step 197 and stores 5 minutes. Some other appropriate period of time may be selected to enable the caller to have a little leeway in keeping his appointment with the elevator car. Step 197 then advances to the disconnect step 112.

If step 196 found that the caller was authorized for more than this predetermined minimum period of time, step 196 advances to step 198 which asks the caller to enter the demand interval length for which he would like to have elevator service at his floor. Step 198 then sets the reply timer and steps 200, 202 and 204 provide the reply timer. If a reply is not received within the reply time period, the program set advance to step 197 which stores the minimum time, or it can advance to step 110 to reset the request. If step 200 receives the information, step 206 stores the demand length, storing the maximum demand length if the caller should request time beyond his authorized maximum. Step 208 then prepares extra system words for the elevator system which are stored in RAM 90, with these words including the floor number, the time-of-day, the number of cars, and the demand length. Step 208 also sets flag No. 1 shown in FIG. 3. Step 208 then advances to the disconnect step 112.

Returning now to step 130, if step 130 finds that the caller desires to cancel a prior request for elevator service, step 210 asks the caller to enter the time-of-day of the prior request, and step 210 then sets the reply timer. Steps 212, 214 and 216 provide the reply delay, and upon receiving the reply, step 218 searches the request table for the prior request. Upon finding the prior request entered by the present caller, it enters zero at the location of the prior stored request. Step 218 then advances to step 220 which asks the caller if he wishes to enter a new request. Step 220 then sets the reply timer and steps 220, 224 and 226 provide the reply delay. Upon receiving the reply, step 228 checks the answer, and if the caller desires to enter a new request the program proceeds to step 132, to process the new entry. If step 228 finds the caller does not wish to enter a new request, step 230 checks the active request table shown in FIG. 3 to see if there are any active requests left in the table. If there are none, step 230 advances to step 234 which resets flag No. 1, and step 234 then advances to the disconnect step. If step 230 finds there are still active requests in the table, step 230 advances directly to the disconnect step 112.

Figure 5:
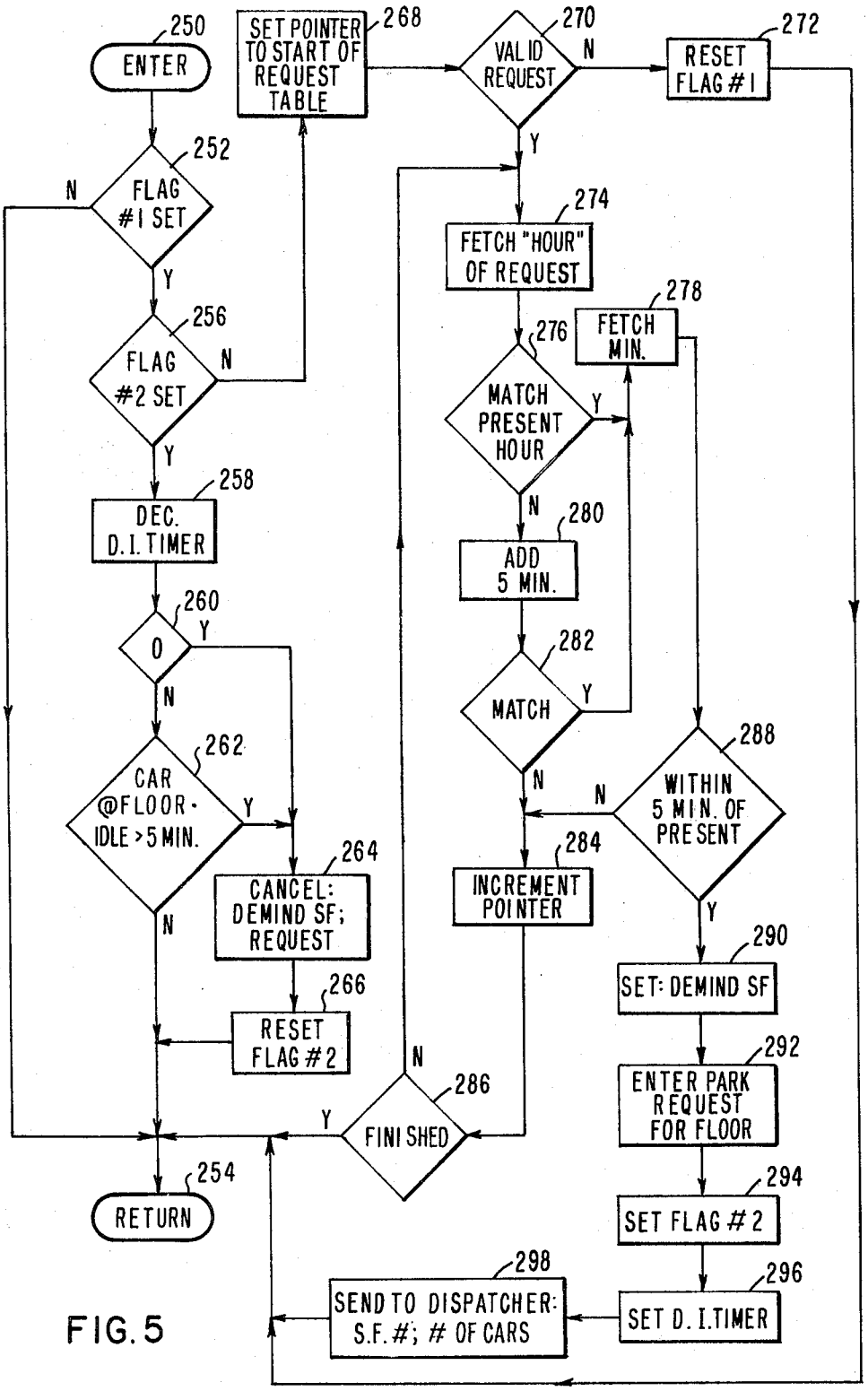
FIG. 5 is a flow chart which sets forth a program for processing the Active Request Table shown in FIG. 3, and for providing output signals for the primary dispatcher of the group supervisory control.

When the microprocessor 80 is not logging new active requests, or preparing messages for the voice box 78, it runs a special floors program shown in FIG. 5. The program shown in FIG. 5 is also stored in PROM 88 shown in FIG. 1. The speical floors program shown in FIG. 5 is entered at 250, and step 252 checks to see if flag No. 1 is set. When flag No. 1 is set it indicates that there are active requests in the active request table shown in FIG. 3. If flag No. 1 is not set, step 252 advances to the "return" at 254. If step 252 finds flag No. 1 set, it advances to step 256 which checks to see if a flat designated as flag No. 2 is set. Flag No. 2 is set as will be observed later on in this program, when one of the requests in the active request table shown in FIG. 3 is being implemented. In other words, when the hour and minute of an active request matches the actual time of day, the demand interval for this request is started and the elevator system then attempts to satisfy this demand. Thus, if step 256 finds that flag No. 2 is set it decrements the demand interval timer shown in FIG. 3. Step 260 checks to see if the demand interval has expired. If it has not expired, step 262 checks to see if there has been a car at this floor which has been idle for more than a predetermined period of time, such as 5 minutes. If step 262 finds this test to be true, it advances to step 262 to cancel the demand, referred to as DEMIND SF, and it zeroes the request in the active request table. Step 264 advances to step 266 to reset flag No. 2 and the program returns to other tasks at step 254. Also, when step 260 finds that the demand interval period has expired, it advances to step 264 to cancel the demand on the elevator system, as well as the request in the active request table.

Returning to step 256, when step 256 finds that flag No. 2 has not been set, it advances to step 268 which sets a pointer to the start of the request table. Since flat No. 1 was set there should be an active request at this location, but step 270 checks to make sure by asking the question "Is there a valid request at this location?". If the request location is all zeroes, the program advances to step 272 which resets flag No. 1 and the program returns to step 254. If step 270 finds a valid request, step 274 then fetches the "hour" of the request. Step 276 checks to see if it matches the present hour. If it does not, step 280 adds 5 minutes to the present hour and then checks to see whether the present hour plus 5 minutes matches the stored hour. If step 282 does not find a match, the program advances to step 284 which increments the pointer and step 286 checks to see if the active request table has been completely processed. If it has not been, step 286 returns to step 274. If the whole table has been processed and no match has been found, step 286 exits the program at the return 254.

If step 276 or step 282 finds a match, the program advances to step 278 which fetches the "minutes" portion of the stored request. Step 288 then determines if the present time-of-day is within a predetermined number of minutes, such as 5, from the stored minutes. If not, the program advances to step 284 to examine the next entry in the active request table. If step 288 finds that the stored request is for a time-of-day which is within a predetermined period of time of the actual time-of-day, step 290 sets a bit of a word which is prepared for sending to the group supervisory control 14, which set bit indicates a demand for an available car, with this demand being referenced DEMIND SF. Step 292 sets another bit of this word which enters a PARK request for the floor in question. Step 292 then advances to step 294 which sets the in-process flag No. 2, and then step 296 sets the demand interval timer shown in the format of FIG. 3. Step 298 then sends the information word to the dispatcher, including the special floor number and the number of cars to be included in the demand. This information is added to the special word which includes the information added by steps 290 and 292. This special word is sent to the output port 94 shown in FIG. 1, and the processor of the group supervisory control is notified that the output port 94 has information for it. This information may be transferred to the group supervisory control 14 serially, such as via an RS 232 data link.

FIGS. 23A and 23B of incorporated U.S. Pat. No. 3,851,734 set forth a subprogram ACR which assigns available cars to demands created by a subprogram ACL, and it may be modified to process demands created by the special floors telephone dispatching feature of the present invention. Program ACR processes the demands in a predetermined priority order, and for purposes of example program ACR will be modified by inserting the telephone demands at the lower end of the priority scale.

Figure 6:
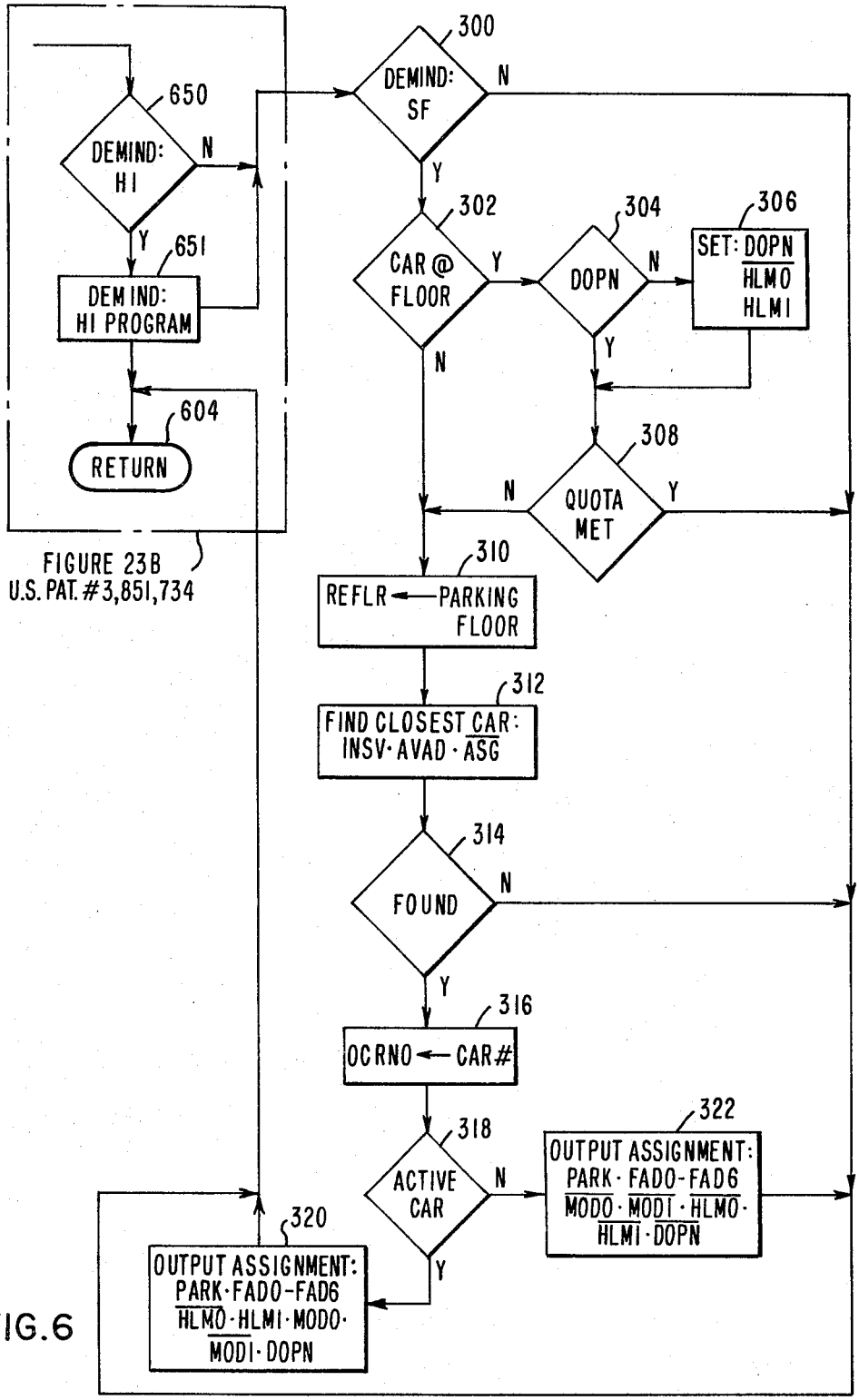
FIG. 6 is a flow chart which illustrates modifications which may be made to the group supervisory control for processing demands for available cars initiated by the program shown in FIG. 5.

FIG. 6 sets forth a modification of FIG. 23B of U.S. Pat. No. 3,851,734, with either step 650 or 651 of program ACR advancing to step 300 which checks to see if there is a demand for a special floor which has been entered via the auxiliary telephone dispatching system. If step 300 does not find such a demand, the program advances to the return at step 604. If step 300 finds such a demand, step 302 checks to see if there is a car already located at the floor in question. If step 302 finds a car at the floor, step 304 checks to see if the car has its doors open (DOPN=1), if the car is at the floor with its doors closed, step 304 advances to step 306 which provides a door open command by sending a true signal DOPN to the car, and by turning on its down hall lantern. The down hall lantern is turned on by preparing signals HLM0 and HLM1. Signal HLM0 is set to a logic 0 and signal HLM1 is set to a logic 1.

If step 304 finds an elevator car at the floor with its doors open, step 308 checks to see if the quota of cars for the floor has been met. If it has, the program returns to step 604 and exits the program. If step 302 did not find a car at the floor, or if step 308 finds that an additonal car is required at the floor, both steps advance to step 310. Step 310 takes the address of the floor FAD-0–FAD6 and stores it at a temporary location REFLR, which means that this floor is now the "reference floor" for a program designed to locate the closest available car to this floor. Step 312 attempts to find an available car which is in service (INSV=1), the car is available according to the dispatcher ($AV\overline{AD}=1$), and the car does not have an assignment ($\overline{ASG}=1$). Step 314 checks to see if such a car has been found. If such a car is not found, the program is exited at the return 604. If such a car has been found, step 314 advances to step 316 which sets a location referred to as OCRN0 to the number of the car which has been found. Step 318 then determines if this car should be an active car, i.e., a car which should park at the floor with its doors open and its appropriate hall lantern on, or whether it should be a backup car which will park at the floor with its doors closed and its hall lanterns off. If step 318 finds that it is to be the active car, step 320 prepares an assignment for the specific car which instructs the car to park at the floor in question with its appropriate hall lantern on, with its doors open, and it is allowed to respond to calls placed only at the floor in question. The latter function is performed by setting the mode bits MOD0 and MOD1 to a logic 1 and a logic 0, respectively.

If step 318 finds that the car is to be a backup car, it prepares an assignment word for the specific car which causes the car to park at the floor with its doors closed and its hall lanterns off. The mode bits are set such that the car cannot recognize any hall calls. Steps 320 and 322 both advance to step 604 which returns to the priority executive.

In summary, there has been disclosed a new and improved elevator system which adds a new dimension to elevator dispatching by using the existing telephone system in the building and automatic telephone answering equipment to enable authorized building tenants to place calls and demands for elevator service. Normal hall calls may be placed by the telephone system, security calls may be placed which orders an empty elevator car to arrive at a predetermined floor at a predetermined time of the day, and service demands may be set up for specified times of the day which automatically creates a demand for this floor for a selected number of cars for a selected demand interval. A multi-level security procedure which includes the telephone number which gains access to the telephone dispatching system, a unique code number, and the knowledge of the floor associated with the code number, all prevent unauthorized use of the telephone dispatching arrangement. The telephone numbers and securing codes may be changed at predetermined intervals, in order to insure continued security of the arrangement.

We claim as our invention:

1. An elevator system, comprising:

a building having a plurality of floors, a plurality of elevator cars mounted in said building to serve the floors therein, means in said building for registering calls for elevator service, group supervisory control means for causing said elevator cars to serve registered calls according to a predetermined strategy, a telephone system in said building, and dispatching control means connected to said telephone system operable to receive and store telephone requests for elevator service, said group supervisory control means being responsive to said telephone request for elevator service stored in said dispatching control means, to cause at least certain of said elevator cars to serve said request.

2. The elevator system of claim 1 wherein said dispatching control means is interactive, including inanimate voice means for providing instructions and for asking questions, and storage means for storing inputs provided by the caller.

3. The elevator system of claim 2 wherein the telephone system is a touch-tone system, with the inputs being provided by the caller via the touch-tone keyboard on the telephone.

4. The elevator system of claim 2 wherein the dispatching control means includes a security code table, means requesting the caller to enter a security code, means for comparing the entered security code with the security code table, and means responsive to a successful comparison for enabling the dispatching control means to store telephoned requests for elevator service.

5. The elevator system of claim 4 wherein each code listed in the security code table enables service to a specified floor of the building.

6. The elevator system of claim 1 wherein the dispatching control means includes a security code table, means requesting the caller to enter a security code, means for comparing the entered security code with the security code table, and means responsive to a successful comparison for requesting the caller to enter a floor number, wherein each code listed in the security table enables service to a specified floor of the building, and further including means for comparing the entered floor number with that enabled by the security code, and means responsive to a successful comparison for enabling the dispatching control means to store telephone requests for elevator service.

7. The elevator system of claim 3 wherein the voice means includes means for asking if the caller desires service now, and including means for receiving the answer, and means for placing a call for elevator service for the floor of the call in response to an affirmative response.

8. The elevator system of claim 3 wherein the voice means includes means for asking for the time-of-day the elevator service is desired, and including means for storing the entered time-of-day, and wherein the group supervisory control means includes means which attempts to park at least one elevator car at the floor of the caller, at the requested time of day.

9. The elevator system of claim 8 wherein the voice means includes means for asking how many cars are desired at the requested time-of-day, means for asking for the time period for which the special service is desired, and including means for storing the responses, and wherein the group supervisory control means includes means which attempts to provide the requested number of cars for the floor during the requested demand interval period.

* * * * *